US007748448B2

(12) United States Patent
Bender

(10) Patent No.: US 7,748,448 B2
(45) Date of Patent: Jul. 6, 2010

(54) WELLHEAD PLUNGER INSPECTION ARRANGEMENT

(75) Inventor: Robert E. Bender, Morrison, CO (US)

(73) Assignee: Well Master Corp, Lakewood, CO (US)

( * ) Notice: Subject to any disclaimer, the term of this patent is extended or adjusted under 35 U.S.C. 154(b) by 232 days.

(21) Appl. No.: 11/715,216

(22) Filed: Mar. 7, 2007

(65) Prior Publication Data

US 2007/0181311 A1 Aug. 9, 2007

Related U.S. Application Data

(63) Continuation-in-part of application No. 11/350,367, filed on Feb. 8, 2006, now Pat. No. 7,395,865.

(60) Provisional application No. 60/790,848, filed on Apr. 10, 2006.

(51) Int. Cl.
*E21B 47/00* (2006.01)
*E21B 33/068* (2006.01)
*E21B 43/00* (2006.01)

(52) U.S. Cl. ..... 166/250.01; 166/68; 166/69; 166/105.2; 166/107; 166/369

(58) Field of Classification Search ..... None
See application file for complete search history.

(56) References Cited

U.S. PATENT DOCUMENTS

2006/0054329 A1* 3/2006 Chisholm ..... 166/372
2006/0090893 A1* 5/2006 Sheffield ..... 166/250.15
2006/0102346 A1* 5/2006 Casey ..... 166/250.15

* cited by examiner

*Primary Examiner*—Zakiya W. Bates
(74) *Attorney, Agent, or Firm*—Don Halgren

(57) ABSTRACT

An oil and gas well production unit for the retrieval of oil and gas from a diminishing oil and gas production field. The unit comprises a well casing within the field attached to a lubricator assembly. A plunger is arranged for reciprocable travel within a tubing in the casing and the lubricator to assist in the production of oil and gas removal from the oil and gas well production unit. A plunger examination port is arranged within the lubricator assembly to permit determination of the amount of wear of the plunger without having to remove the plunger from the lubricator assembly.

19 Claims, 4 Drawing Sheets

WELLHEAD PLUNGER INSPECTION ARRANGEMENT

This invention is a condition-in-part application of U.S. patent application Ser. No. 11/350,367, filed Feb. 8, 2006 now U.S. Pat. No. 7,395,865 and also based upon Provisional Patent Application 60/790,848 filed Apr. 10, 2006, each of which are incorporated herein by reference.

BACKGROUND OF THE INVENTION

1. Field of the Invention

This invention relates to oil and gas wellhead monitors and more particularly to apparatus and arrangements for inspecting a plunger utilized within that wellhead which permits inspection of that plunger, to determine its and the wellhead's condition.

2. Prior Art

In the life of an oil or gas well, eventually the bottom hole pressure and the gas to liquid ratio will not support a natural flow therefrom. The well operator at that time must select an "artificial lift" to remove fluid from the well so as to resume production. A "plunger lift" is a form of artificial lift which may be utilized in maintaining production levels and stabilizing the rate of decline and production of oil and gas from a well.

For such a plunger lift apparatus to be functional, there must be sufficient gas present to drive the system. Oil wells which are producing no gas are not plunger lift candidates. An industry misconception exists as to how much gas and pressure is required to successfully operate a plunger lift system. Because of this misconception, many wells have been placed on more expensive forms of an artificial lift, such as pumping units or the like, than are really needed. As a result, optimum output has not been achieved, and capital expenditures have run much higher than necessary.

As the oil flow rate and pressure decline in a well, the lifting efficiency declines geometrically. The well then may begin to "load up" and "log off". This means that gas being produced into the well bore can no longer carry the liquid produced to the surface. The reasons for this are that as liquid comes in contact with the wall of the production string or tubing, friction will occur. The velocity of that liquid is thus slowed and some of the liquid adheres to the tubing wall, creating a film of liquid on that tubing wall. Thus, that liquid does not reach the surface of the well head.

Further, as the flow velocity continues to slow, the gas phase can no longer support liquid in either slug form or droplet form. This liquid along with the liquid film on the sides of the tubing begin to fall back to the bottom of the well. In a very aggravated situation there will be liquid in the bottom of the well with only a small amount of gas being produced at the surface. The produced gas must bubble through the liquid at the bottom of the well and then flow to the surface. Because of the low velocity, very little liquid if any is carried to the surface of the well by the gas.

The corresponding head of liquid in the bottom of the well exerts a back pressure against the producing formation in a value equal to its weight, effectively terminating the well's ability to produce. A properly applied "plunger lift" system is able to bring such a well back into life and make it extremely profitable.

A plunger lift system permits the well to be opened and closed so as to generate a sufficient pressure permitting the well to flow into the flow line. The plunger within this tubing however freely travels the vertical tubing string and is used as an interface between the liquid phase and the gas phase. The use of such a plunger in the tubing, minimizes any fluid fallback over the entire length of the tubing, irrespective of that depth of the well. Such a well may be operated therefore at a lower bottom hole pressure since all the liquid is removed from the well bore, thus enhancing its production.

The plunger in this particular system travels freely back and forth, from the bottom of the well to the surface and back to the bottom. The plunger is used as a mechanical interface between the gas phase and the fluid phase in the well. When the well is closed at the surface, the plunger rests at the bottom of the well, on top of a spring assembly. When the well is opened at the surface, with all production being through the tubing, the well begins to flow and the pressure in the tubing decreases. Because the trapped gas in the casing/tubing annulus remains at a higher pressure than the tubing, the differential pressure between the two increases. The fluid level in the annulus decreases as the fluid is pushed downward where it "U tubes" into the tubing. The mechanical tolerance between the outside diameter of the plunger and the inside of the tubing leaves sufficient space for the fluid to bypass the plunger, allowing it to remain resting on the bottom. Expansion properties of gas within the tubing causes the plunger to move up the tubing string with the fluid load on top. A small amount of gas will bypass the plunger. This is useful as it scours the plunger and the tubing wall of fluid keeping all the fluid on top of the plunger. If the system has been properly engineered, virtually all the fluid can be removed from the well to permit the well to flow at the lowest production pressure possible. Thus production is consequently optimized.

At the top of the well head, there is a lubricator. The lubricator is arranged to place the plunger in the well and to retrieve the plunger from the well without having to kill the well. The lubricator may have a sensor to detect the plunger's arrival at the surface, sending a signal to a controller for various controller functions to help optimize production.

The plunger traveling through the system of the tubing however certainly suffers wear along its outer peripheral surface. The lifespan of a typical plunger may vary anywhere from about six months to about a year. There is a need to determine when to replace such a plunger so as to maximize the efficiency of the entire system. It is also therefore not always desirable to physically remove the plunger through the lubricator, to inspect it so as to otherwise slow down the operation of the well.

It is an object of the present invention to overcome the disadvantages of the prior art.

It is a further object of the present invention to provide a plunger inspection arrangement which optimizes wellhead output.

It is yet a further object of the present invention to provide a plunger which has means to indicate when it is time to be replaced.

BRIEF SUMMARY OF THE INVENTION

The present invention relates to an arrangement for determining the condition of a plunger utilized within an oil and gas well production unit. Such an oil and gas well production unit comprises a casing which is driven into the soil in an oil and gas production field. The casing has a plurality of perforations at its lowermost end through which oil and gas travel to be drawn into a preferably vertically arranged tubing or string to deliver oil and gas to the surface of that field.

The upper end of the production well unit comprises a lubricator. The tubing is in fluid communication with the inside of the lubricator. The lower end of the tubing has a seat cup spring assembly which acts as a stopper for the lower end of the tubing and a stop for the plunger which travels vertically within the tubing and within the lubricator thereattached. The plunger cycles vertically within the tubing and lubricator on a daily basis, depending upon the flow rate and pressure of the oil and gas received within the casing. That continued vertical reciprocal movement of the plunger within the tubing effects a wearing on the peripheral surface of the plunger. Over a period of six months to twelve months that plunger will likely need to be changed because of excessive wear on its outer surface. Failure to change it at a proper interval will deteriorate the production and performance of that particular well unit.

The lubricator, at the upper end of the well unit, comprises an uppermost lubricator cap. The lower end of the lubricator is attached to the upper end of the production tubing through a lowermost housing. The master valve is arranged through the lowermost housing to open and close the well manually, to take pressure off the surface equipment of that well unit. Immediately above the master valve, in the lower end of the lubricator, there is a flow outlet in fluid communication with the lubricator. Above the lower flow outlet there is a second flow outlet which is in communication with a fluid discharge conduit for discharge of oil and gas from that well unit. The flow outlets come together into a common flow line. The common flow line connects to a motor valve and controller which becomes an automatic on/off control unit for each specific production well unit.

A catcher mechanism is arranged opposite the second flow outlet, to seize the plunger in its verticalmost travels, in case that plunger needs to be inspected and/or replaced.

A viewing window or port is arranged through the lower portion of the lubricator wall generally opposite the lower flow outlet arranged in the lubricator housing.

A needle valve may be arranged on the lubricator housing wall. The needle valve is utilized to bleed the lubricator pressure to atmospheric, to permit the top of the lubricator to be removed to enable the plunger to be seized for viewing by the catcher mechanism thereabove.

The viewing window may comprise a cylindrically shaped member weldably attached to the lubricator housing, having a lens sealingly arranged on a distal end of that cylindrically shaped member.

In a further embodiment of that viewing window, such a member may comprise a generally rectangular frame which is weldably attachable to the lubricator housing opposite the lower flow outlet, with a clear window for viewing a plunger captured thereadjacent. Such a vertically elongated viewing window eliminates the need for removal of the lubricator cap and retrieval of the plunger from the uppermost end of the lubricator for visual manual inspection thereof. Such manual inspection is time consuming and messy. Such manual inspection and removal requires the well to be shut down for a period of time to complete that inspection of the plunger.

The plunger itself in a first preferred embodiment thereof may have markers or wear surfaces thereon or a surface alarm mechanism therewith, to indicate when that plunger should be replaced.

In a first preferred embodiment of the plunger wear mechanism, a plurality of generally radially directed holes may be formed within the wall of the plunger, from an inside to an outwardly extending direction. Those particular holes would be initially formed leaving a thin walled portion of the outer wall of the plunger at the radially outer end of each of those holes. As the plunger wears, that thin walled portion thereof would expose the holes or openings to the view port window arranged within the lubricator. Thus the appropriate type plunger replacement time may be readily observed, once those holes appear in the outer wall surface of the plunger.

A further preferred wear indicator on a plunger may comprise an annular ring extending circumferentially outwardly a known distance from the generally cylindrical wall of that plunger assembly. When that wear ring is worn down even with the cylindrical wall portion of the plunger, such a worn annular ring will indicate time for replacement of that plunger assembly.

A yet further preferred wear indicator arrangement may comprise one or more annular channels arranged within the outer wall of the elongated plunger. When those particular channels are no longer visible, wear of the outer wall of the plunger to a particular depth is visually indicated, necessitating the replacement of that particular plunger within the well unit.

A yet further wear indicator arrangement is contemplated by a plurality of electrodes arranged within the wall of the plunger. The electrodes are connected to a proper alarm circuit with a battery operated electromagnetic or audible signal transmitter/alarm therewithin. Once those contact electrodes are exposed to the inner wall of the tubing or lubricator as the plunger wall erodes from wear thereof, the contact electrodes establish a circuit within the lubricator walls, to transmit a signal to a receiving unit outside of the wellhead itself. Such a signal would indicate that the wall thickness of the plunger has worn down to an extent where that plunger needs to be replaced. It is further contemplated that that RF signal generator, may also be arranged to send pressure signals, cyclical signals for counting the number of times the plunger has traveled within the lubricator in any given unit of time, the viscosity or temperature of any fluid within the tubing of the casing, or other features of that fluid such as chemical composition, moisture content or the like to a receiving unit at the surface of the well, for production concerns therewith.

Thus there has been shown a unique oil and gas well plunger monitoring arrangement, wherein plunger replacement is readily determined by visual inspection of that plunger without having to remove it each time from the well's lubricator assembly. The plunger itself has a wear indicator or signal sending unit to indicate operating parameters of that plunger, the particular parameters of the gas and oil being transmitted through the tubing and to the flow outlets and cyclical conditions to indicate the general health of the well unit itself.

The invention thus comprises an oil and gas well production unit for the retrieval of oil and gas from a diminishing production field, comprising: a well casing within the field and attached to a lubricator assembly, a plunger arranged for reciprocable travel within a tubing in the casing and the lubricator to assist in the production of oil and gas removal from the oil and gas well production unit. A plunger examination port is arranged within the lubricator assembly to permit determination of the amount of wear of the plunger without having to remove the plunger from the lubricator assembly. The plunger examination port may comprise an optically transmissive window to permit articulable, focusable visual inspection of a plunger received thereadjacent. The plunger examination port may comprise an electronic sensor to pick up electromagnetic signals from a signal generator arranged within the plunger. The window may comprise a removable lens secured to a housing communicatively attached through a wall portion of the lubricator assembly. The signal generator may comprise electrodes buried within wall portions of the plunger. The plunger examination port may comprise an elongated window assembly arranged communicatively through a wall portion of the lubricator assembly to permit longitudinal examination of a plunger captured thereadjacent. The plunger may have visually observable wear indicators thereon to indicate when the plunger should be removed and replaced from the production unit. The wear indicators in the plunger may comprise a plurality of holes arranged partway through a wall portion of the plunger, to indicate time to replace a plunger when the holes are observable at the examination port. The wear indicators may comprise at least one annular wear ring arranged circumferentially about the plunger, to indicate time to replace a plunger when the at least one annular ring is no longer observable at the examination port. The wear indicators may comprise at least one annular wear channel arranged circumferentially about the plunger, to indicate time to replace a plunger when the at least one annular wear channel is no longer observable at the examination port. The wear indicators may comprise at least one wear sensor arranged within a wall portion of the plunger, to indicate time to replace a plunger when the plunger has exposed the wear sensor and thus completes a circuit for sensing by a receiving unit communication with the lubricator assembly.

The invention may also include a method of determining the need for replacement of a oil and gas production assist plunger in an oil and gas well production unit, the oil and gas well production unit comprising a lower well casing in fluid communication with a lubricator assembly and flow outlet arrangement thereon. The steps may include: attaching an examination port onto the lubricator assembly to permit examination of a plunger traveling thereadjacent. The examination port may comprise a visual examination permitting window arranged thereat. The examination port may includes an electronic sensor arranged to pick up signals generated by the plunger. The method may include one or more of the following steps: arranging a plurality of visually observable wear indicators on the plunger; installing a plurality of hole partway through a wall portion of the plunger to permit observation at the examination port, of the holes upon wear of the plunger; forming at least one wear ring about an annular portion of the plunger; forming at least one wear channel into a annular portion of the plunger.

The invention also includes an oil and gas well production unit for the retrieval of oil and gas from a diminishing production field, comprising: a well casing within the production field attached to a lubricator assembly; a plunger arranged for reciprocable travel within the casing, the lubricator being arranged to assist in the production of oil and gas removal from the oil and gas well production unit; a plunger examination port arranged within the lubricator assembly to permit condition sensing of the plunger without having to remove the plunger from the lubricator assembly. The plunger may preferably have a well-condition sensor arranged therewith for reporting oil, gas and well conditions to a signal receiving arrangement in communication with the well production unit. The well-condition sensor within the plunger may comprise a sensor reporting oil and gas parameters and well inside-conditions.

BRIEF DESCRIPTION OF THE DRAWINGS

The objects and advantages of the present invention will become more apparent, when viewed in conjunction with the following drawings, in which.

DETAILED DESCRIPTION OF THE INVENTION

Figure 1:
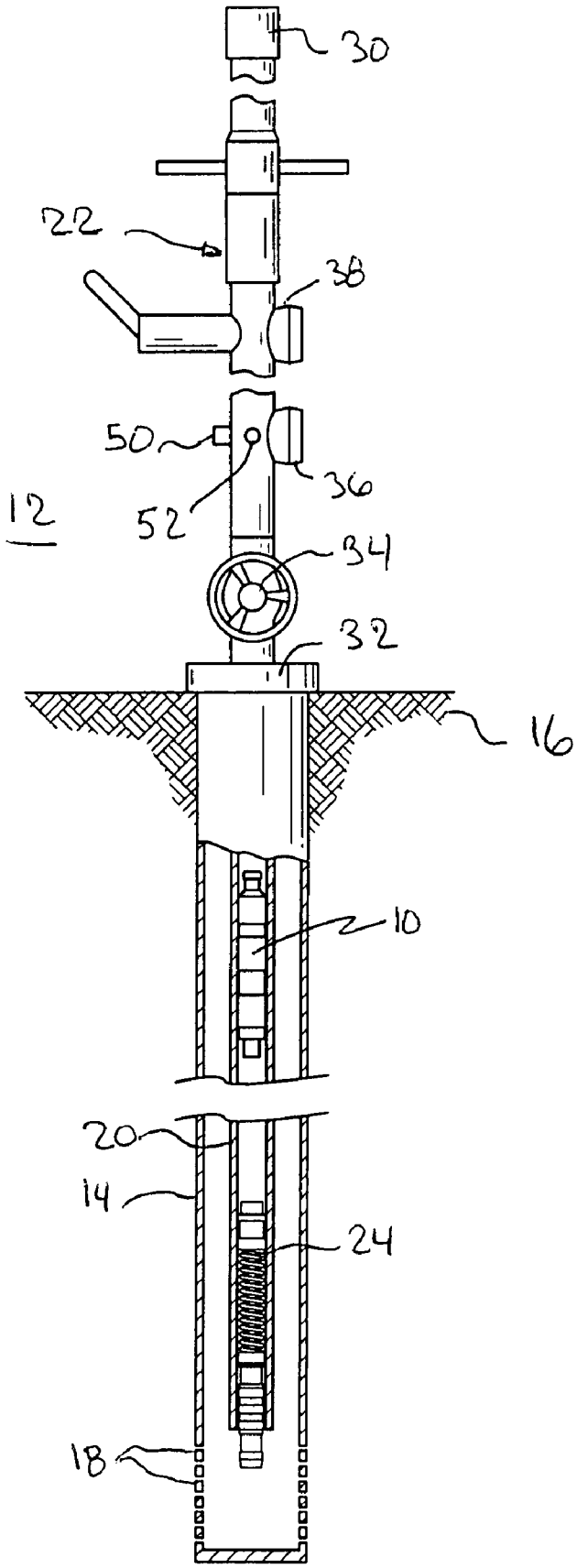
FIG. 1 is a side elevational view of an oil and gas well assembly.

The present invention comprises an arrangement for determining the condition of a plunger 10 (represented in FIG. 5) utilized within an oil and gas well production unit 12, as represented in FIG. 1. Such an oil and gas well production unit 12 comprises a casing 14 which is driven into the production soil 16 in an oil and gas production field. The casing 14 has a plurality of perforations 18 at its lowermost end through which oil and gas travel to be drawn into a preferably vertically arranged tubing or string 20 to deliver oil and gas to the surface of that field.

The upper end of the production well unit 12 comprises a lubricator 22. The upper end of the tubing or string 20 is in fluid communication with the inside of the lubricator 22. The lower end of the tubing 20 has a seat cup and spring assembly 24 which, acts as a stopper for the lower end of the tubing 20 and a stop for the plunger 10 which travels vertically within the tubing 20 and within the lubricator 22 thereattached. The plunger 10 cycles vertically within the tubing 20 and lubricator 22 on a periodic basis, depending upon the flow rate and pressure of the oil and gas received within the casing 14. That continued vertical reciprocal movement of the plunger 10 within the tubing 20 effects a wearing on the outer peripheral surface 26 of the plunger 10, represented in FIG. 5. Over a period of six months to twelve months a typical plunger 10 will likely need to be changed because of excessive wear on its outer surface 26. Failure to replace a worn plunger 10 at a proper interval will deteriorate the production and performance of that particular well unit 12.

Figure 2:
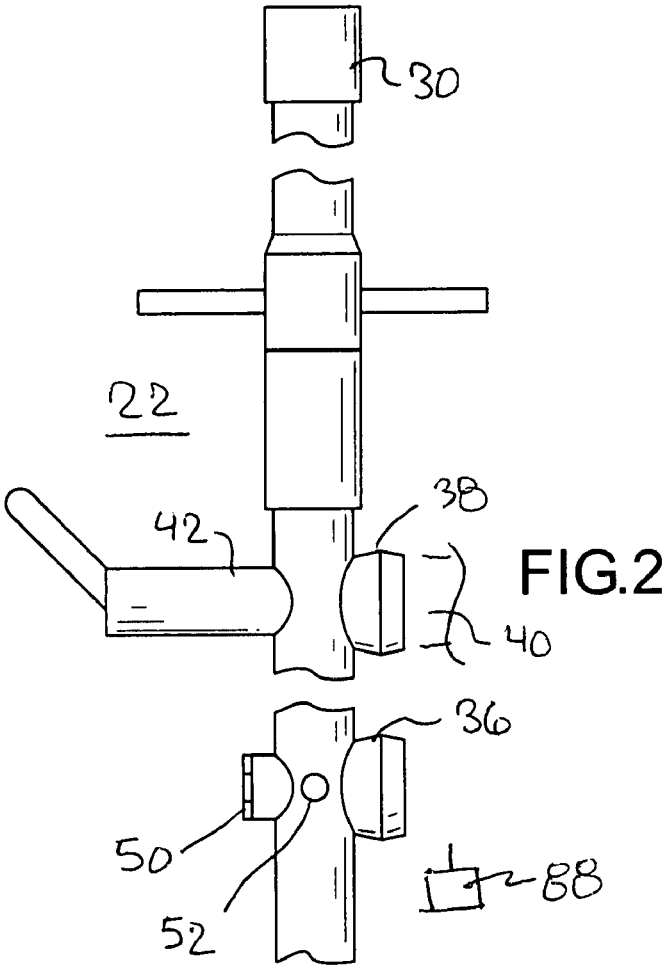
FIG. 2 is a side elevational view of the lubricator portion of that oil and gas assembly shown in FIG. 1.

The lubricator 22, at the upper end of the well unit, comprises an uppermost lubricator cap 30, as represented more specifically in FIG. 2. The lower end of the lubricator 22 is attached to the upper end of the casing 14 through a lowermost housing 32, represented in FIG. 1. A master valve 34 is arranged through the lowermost housing to open and close the well, to take pressure off the surface equipment of that well unit 12. Immediately above the master valve 34, in the lower end of the lubricator 22, there is a first flow outlet 36 in fluid communication with the lubricator 22. Above the first flow outlet 36 there is a second flow outlet 38 which is in communication with a fluid discharge conduit 40 for discharge of oil and gas from that well unit 12. The first and second flow outlets 36 and 38 are combined into a common conduit, not shown herein for clarity.

A plunger catcher mechanism 42 is arranged generally opposite the second flow outlet 38, and is arranged to seize the plunger 10 in its verticalmost travels when necessary, or as indicated automatically, identified hereinbelow, in case that plunger 10 needs to be inspected and/or replaced.

A viewing window or port 50, is arranged through the lower portion of the wall of the lubricator 22 generally opposite the first or lower flow outlet 36, arranged in the housing of the lubricator 22, as represented in FIGS. 1 and 2.

A needle valve 52 may be arranged through the housing of the lubricator 22 adjacent the viewing window or port 50. The needle valve 52 is utilized to bleed the lubricator pipe, to facilitate viewing the condition of the plunger 10 when it is periodically "seized" for viewing by the plunger catch mechanism 42 stationed thereabove.

Figure 3:
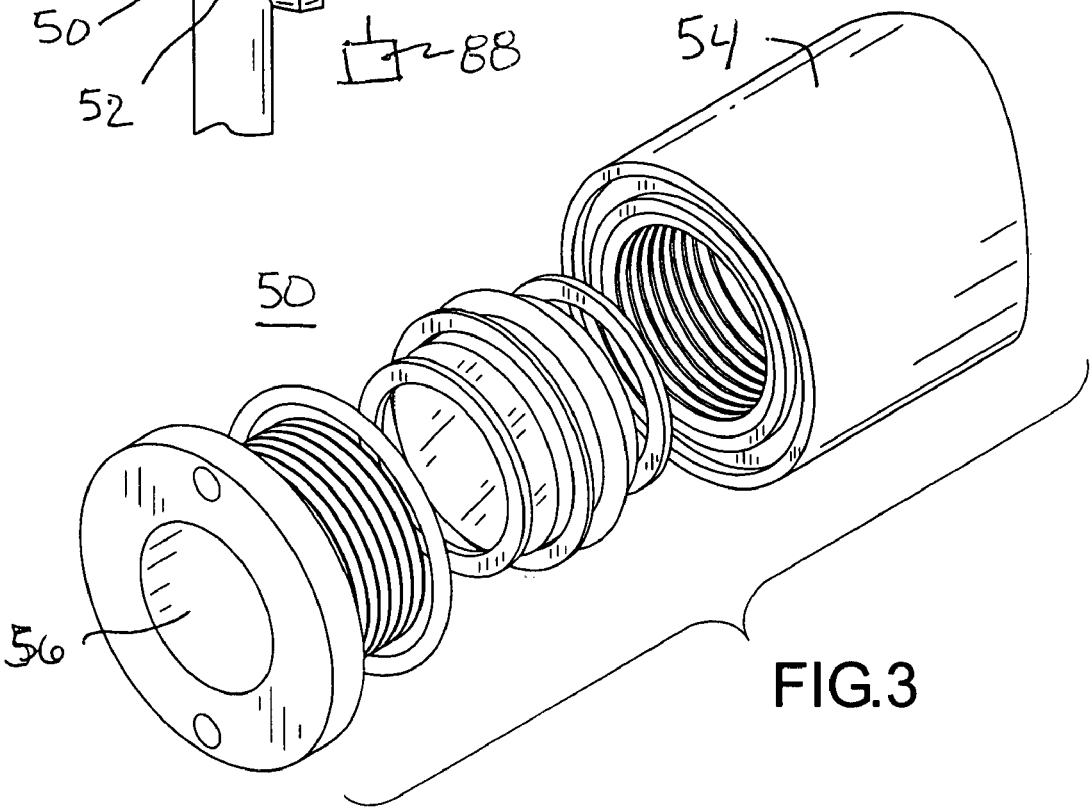
FIG. 3 is an exploded view of a viewing window arranged through the lubricator of that well shown in FIG. 2.

The viewing window or port 50 may in a first preferred embodiment as represented in FIG. 3, comprise a cylindrically shaped member 54 weldably attachable to the housing of the lubricator 22, as represented in FIG. 2. The port 50, shown in FIG. 3 has a lens 56 threadedly and sealingly and removably arranged on a distal end of that cylindrically shaped member 54. The lens 56 may be unscrewed for cleaning, adjustment and/or focusing or articulation to assist in examination of the plunger 10.

Figure 4:
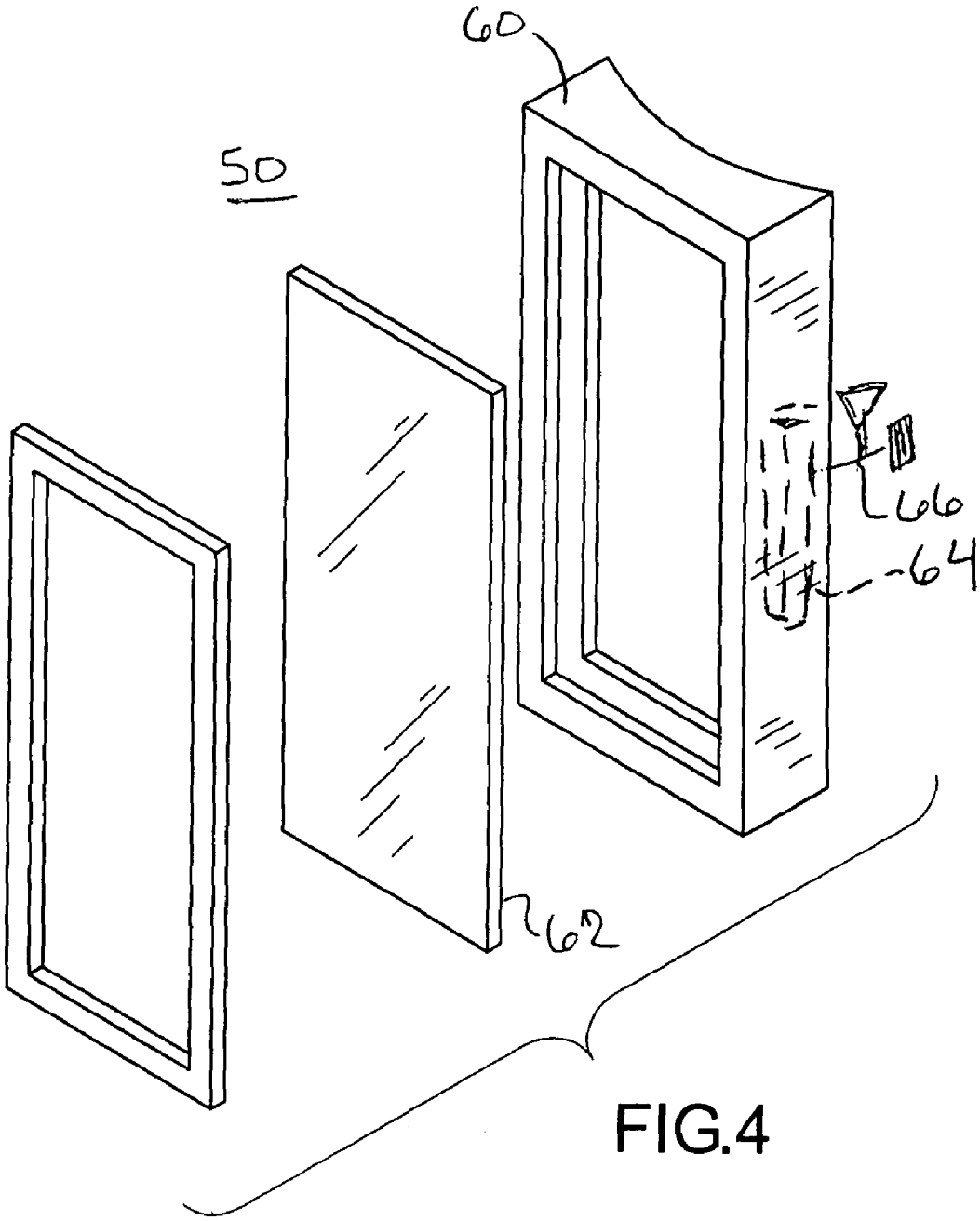
FIG. 4 is an exploded view of a further viewing assembly utilizable on a lubricator of a gas and oil well.

In a further preferred embodiment of that viewing window or port 50, as may be seen in FIG. 4, the port 50 may be comprised of a generally elongated, rectangular frame 60 for weldable attachment to the housing of the lubricator 22, preferably opposite the first or lower flow outlet 36, with a clear window 62 to permit a more longitudinally elongated viewing and surface inspection of a plunger 10 captured thereadjacent.

The frame 60 may, for example, include an illumination and/or camera or sensor and electronic transmission examination means 64 to provide light and/or to permit remote examination, through a proper circuit 66, of a periodically scheduled computer actuated capture by the plunger catcher mechanism 42 of the plunger 10, for off-site maintenance personnel. Such a vertically elongated viewing port 50 and examination means 64 eliminates the need for constant removal of the lubricator cap 30 and retrieval of the plunger 10 from the uppermost end of the lubricator 22 for visual manual inspection thereof, or for even having personnel actually being on the site of the production well 12. Such manual inspection of the prior art, is time consuming and messy. Such prior art manual inspection and removal of a plunger requires the well to be shut down for an extended period of time to complete that inspection of the plunger.

Figure 5:
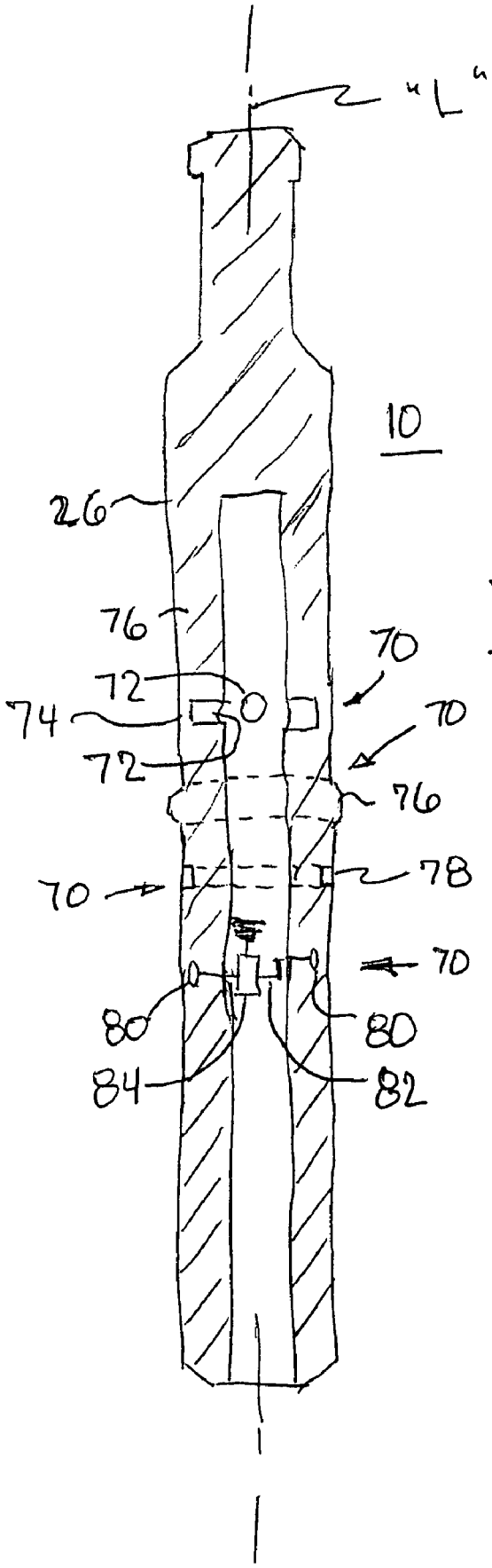
FIG. 5 is a longitudinal sectional view of a plunger utilizable within an oil gas well unit, showing several wear indicator embodiments for use within that viewing system and well head unit.

The plunger 10 itself, in a first preferred embodiment thereof, as represented in FIG. 5, may have markers or wear surfaces thereon or a surface alarm mechanism 70 therewith, to indicate when that plunger 10 should be replaced.

In a first preferred embodiment of the plunger wear mechanism 70, a plurality of generally radially directed holes 72, represented in FIG. 5, may be formed within the wall of the plunger 10, from an inside to an outwardly extending direction or vice versa. Those particular holes 72 would be initially formed leaving a thin walled portion 74 of the outer (or inner) wall 76 of the plunger 10 at the radially outer end of each of those holes 72. As the plunger 10 wears, that thin walled portion 74 thereof would wear and hence expose (or wear down) the holes or openings 72 to the view port window 50 and/or the examination means 64 arranged within the lubricator 22. Thus the appropriate type plunger replacement time may be readily observed or sensed, once those holes 72 appear in the worn away or disappear from the outer wall surface 74 of the plunger 10.

A further preferred wear indicator 70 on a plunger or plunger assembly 10, also represented in FIG. 5, may comprise an annular ring 76 extending circumferentially outwardly a known distance from the generally cylindrical wall 26 of that plunger assembly 10. When that wear ring 76 is worn down even with the cylindrical wall portion 26 of the plunger 10, such a worn away annular ring 76 will indicate time for replacement of that plunger assembly 10.

A yet further preferred wear indicator arrangement 70, again represented in FIG. 5, for convenience of drawing, may comprise one or more annular channels 78 arranged within the outer wall 26 of the elongated plunger 10. When those particular channels 78 are no longer visible, wear of the outer wall 26 of the plunger 10 to a particular predetermined depth is visually or sensorily indicated, necessitating the replacement of that particular plunger 10 within the well unit 12.

A yet further wear indicator arrangement 70 is contemplated by a plurality of electrodes 80 arranged to a particular radially inwardly directed depth within the wall 26 of the plunger 10, as is represented in FIG. 5. The electrodes 10 in this embodiment are connected to a proper alarm circuit 82 having for example, a battery operated rf transmitter 84 therewithin. Once those contact electrodes 80 are exposed by wear of the surface 26 to the inner wall of the tubing 20 or lubricator 22 as the plunger wall erodes from wear thereof, the contact electrodes 80 establish a circuit within the lubricator walls 22, to transmit, for example, an electromagnetic or rf signal to a sensor receiving unit and proper circuit 88, represented in FIG. 2, outside of the wellhead itself. Such a signal could indicate that the wall thickness of the plunger 10 has worn down (or the well casing has worn down) to an extent where that plunger 10 (or casing) needs to be replaced. It is further contemplated that the electromagnetic or rf signal generator 84, may also be arranged to send pressure signals, cyclical signals for counting the number of times the plunger 10 has traveled within the lubricator 22 in any given unit of time, the viscosity or temperature of any fluid within the tubing of the casing 14, or other features or parameters of that fluid such as chemical composition, moisture content or the like to the receiving unit 88 at the surface of the well as well as the conditions of the inner surface of the well, for production concerns therewith.

Thus there has been shown a unique oil and gas well plunger monitoring arrangement, wherein plunger replacement is readily determined by simple visual and/or mechanical, optical, electrical or chemical sensor inspection of that plunger without having to remove it each time from the well's lubricator assembly. The plunger itself may have a wear indicator 70 and/or signal sending unit 84 to indicate operating parameters of the plunger, the particular parameters of the gas and oil being transmitted through the tubing and to the flow outlets and cyclical conditions to indicate the general health of the well unit itself.

The invention claimed is:

1. An oil and gas well production unit for the retrieval of oil and gas from a diminishing production field, comprising:

a well casing within said production field attached to a lubricator assembly;

an electromagnetic or audible signal generating plunger arranged for reciprocable travel within a tubing in said casing, said lubricator being arranged to assist in the production of oil and gas removal from said oil and gas well production unit;

a plunger examination port arranged within said lubricator assembly to permit determination of the amount of wear of said plunger without having to remove said plunger from said lubricator assembly, said plunger examination port comprises an optically transmissive window to permit visual inspection of a plunger received thereadjacent, and a sensor arranged with the assembly, to receive the audible and/or electromagnetic signals from the signal generating plunger.

2. The oil and gas production unit as recited in claim 1, wherein said window comprises a removable lens secured to a housing communicatively attached through a wall portion of said lubricator assembly.

3. The oil and gas production unit as recited in claim 1, wherein said signal generating plunger has electrodes buried within wall portions of said plunger.

4. The oil and gas production unit as recited in claim 1, wherein said plunger examination port comprises an elongated window assembly arranged communicatively through a wall portion of said lubricator assembly to permit longitudinal examination of a plunger captured thereadjacent.

5. The oil and gas production unit as recited in claim 1, wherein said plunger has visually observable wear indicators thereon to indicate when said plunger should be removed and replaced from said production unit.

6. The oil and gas production unit as recited in claim 5, wherein said wear indicators in said plunger comprise a plurality of holes arranged partway through a wall portion of said plunger, to indicate time to replace a plunger when said holes are observable or not, upon examination and sensing thereof at said examination port.

7. The oil and gas production unit as recited in claim 5, wherein said wear indicators comprise at least one annular wear ring arranged circumferentially about said plunger, to indicate time to replace a plunger when said at least one annular ring is no longer observable at said examination port.

8. The oil and gas production unit as recited in claim 5, wherein said wear indicators comprise at least one annular wear channel arranged circumferentially about said plunger, to indicate time to replace a plunger when said at least one annular wear channel is no longer observable at said examination port.

9. The oil and gas production unit as recited in claim 5, wherein said wear indicators comprise at least one wear sensor arranged within a wall portion of said plunger, to indicate time to replace a plunger when said plunger has exposed said wear sensor and thus completes a circuit for sensing by a receiving unit communication with said lubricator assembly.

10. A method of determining the need for replacement of a oil and gas production assist plunger in an oil and gas well production unit, said oil and gas well production unit comprising a lower well casing in fluid communication with a lubricator assembly and flow outlet arrangement thereon, comprising:

controllably moving a signal generating plunger upwardly and downwardly within said oil and gas well production unit, to facilitate the production of oil and gas output from said oil and gas well production unit, the signals being sent from the plunger comprising audible and/or electromagnetic signals, and wherein said lubricator assembly includes a plunger examination port which comprises a visual examination-permitting window;

arranging a plunger signal receiving sensor with said lubricator assembly to permit examination of said plunger traveling within said production unit.

11. The method as recited in claim 10, wherein said signals are electromagnet signals created by a signal generator in said plunger.

12. The method as recited in claim 10, wherein said signals are audible signals created by an audible signal generator within said plunger.

13. The method as recited in claim 10, including:

arranging a plurality of visually observable wear indicators on said plunger.

14. The method as recited in claim 10, including:

installing a plurality of holes partway through a wall portion of said plunger to permit observation at said examination port, of said holes upon wear of said plunger.

15. The method as recited in claim 10, including:

forming at least one wear ring about an annular portion of said plunger.

16. The method as recited in claim 10, including:

forming at least one wear channel into a annular portion of said plunger.

17. An oil and gas well production unit for the retrieval of oil and gas from a diminishing production field, comprising:

a well casing within said production field attached to a lubricator assembly;

a signal generating plunger arranged for reciprocable travel within said casing, said lubricator being arranged to assist in the production of oil and gas removal from said oil and gas well production unit, wherein the signals generated by the plunger are selected from the group consisting of: audible signals and/or electromagnetic signals;

a plunger signal receiving sensor and a plunger examination port wherein said plunger examination port comprises an optically transmissive window to permit visual inspection of a plunger received thereadjacent arranged with said lubricator assembly to permit condition sensing of said plunger without having to remove said plunger from said lubricator assembly.

18. The oil and gas well production unit as recited in claim 17, wherein said plunger has a well-condition sensor arranged therewith for reporting oil, gas and well conditions to a signal receiving arrangement in communication with said well production unit.

19. The oil and gas well production unit as recited in claim 18, wherein said well-condition sensor within said plunger comprises a sensor reporting oil and gas parameters and well inside-conditions.

* * * * *